United States Patent [19]

Cadars et al.

[11] 4,394,141

[45] * Jul. 19, 1983

[54] EXPANSION TANK AND WATER BOX DEVICE FOR HEAT EXCHANGER, SUCH AS A RADIATOR OF A MOTOR VEHICLE

[75] Inventors: Patrick Cadars, Maurepas; Bruno Hellouin de Cenival, Noisy le Roi, both of France

[73] Assignee: VALEO, Paris, France

[ * ] Notice: The portion of the term of this patent subsequent to Sep. 15, 1998, has been disclaimed.

[21] Appl. No.: 263,357

[22] Filed: May 14, 1981

Related U.S. Application Data

[63] Continuation of Ser. No. 48,249, Jun. 13, 1979, Pat. No. 4,289,507.

[30] Foreign Application Priority Data

Jun. 15, 1978 [FR] France ..... 78 17966

[51] Int. Cl.³ ..... B01D 53/00; F01P 5/10

[52] U.S. Cl. ..... 55/195; 55/208; 165/42; 165/148

[58] Field of Search ..... 55/189, 192, 182, 195, 55/208; 165/42, 51, 81, 108, 148, 149–151

[56] References Cited

U.S. PATENT DOCUMENTS

| | | | |
|---|---|---|---|
| 1,550,116 | 8/1925 | Smith | 55/195 |
| 1,734,515 | 11/1929 | Elliott | 55/195 X |
| 2,343,886 | 3/1944 | Cornell, Jr. | 55/195 |
| 2,478,428 | 8/1949 | Shaw et al. | 55/200 |
| 3,939,901 | 2/1976 | Cieszko . | |
| 4,084,944 | 4/1978 | Chirioo | 55/208 |

FOREIGN PATENT DOCUMENTS

| | | | |
|---|---|---|---|
| 2545458 | 10/1975 | Fed. Rep. of Germany . | |
| 2728331 | 6/1976 | Fed. Rep. of Germany . | |
| 7817966 | 6/1978 | France . | |
| 7912783 | 5/1979 | France . | |
| 196064 | 4/1923 | United Kingdom | 55/195 |
| 1270238 | 4/1972 | United Kingdom . | |
| 1510175 | 5/1978 | United Kingdom . | |

*Primary Examiner*—John Adee

*Attorney, Agent, or Firm*—Eyre, Mann, Lucas & Just

[57] ABSTRACT

An expansion tank and water box device for a heat exchanger with a nest of parallel tubes, such as a radiator of a motor vehicle, in which the water box housed inside the expansion tank is maintained by the assembly of the tank with the hollowed plate through which extend the ends of the tubes. Ribs are interposed between the water box and the expansion tank. Said ribs depend, for instance, from the expansion tank.

45 Claims, 29 Drawing Figures

105a
111
112
117₁
117₂

111a
112a 113
105a
114
111
112
116
12
12
115

105
109
103
102
104
110
107₁
101
107₃
107₄
107₂
108

261
262
263
264
265
266
267
268
269
271
272
273
274
275
275'
276
277
278
279
280
281
282
282'
283
283'
284
284'
285
286
286'
287
287'
288
288'
289
291
292
297
298
299
301
302
303
304
294
293
295

EXPANSION TANK AND WATER BOX DEVICE FOR HEAT EXCHANGER, SUCH AS A RADIATOR OF A MOTOR VEHICLE

This is a continuation of application Ser. No. 048,249, filed June 13, 1979, now U.S. Pat. No. 4,289,507.

The object of the invention is an expansion tank and a water box for a heat exchanger such as a motor vehicle radiator.

The invention applies to heat exchangers in which the water circulation tubes extend, at a least one end thereof, through a hollowed plate or manifold limiting with a water box connected to it a collecting chamber.

There has been proposed, for a motor vehicle radiator with horizontal tubes in which flows the water to be cooled, to integrate to one of the water boxes of the radiator an expansion tank so as to form a chamber which, in combination with the collecting chamber, maintains the installation comprising the radiator at a good filling degree by eventually making up for the losses, and allows also the expansion of the water and provides for the degassing, that is the evacuation of the air which may be present in the form of bubbles in the liquid flowing through the installation. But, in this known device, the cross-section of the compensation chamber is, at most, equal to that of the filling plug which it comprises; its volume is therefore limited.

There has been proposed a motor vehicle radiator in which the tubes of the nest extend at one end through a hollowed plate and emerge thus in a collecting chamber limited by said plate and a water box, an expansion tank the edge of which is connected to that of the hollowed plate and of the water box limiting with the box a compensation chamber.

But this device is of difficult manufacture if it has to be provided, for a small weight, with a sufficient mechanical strength as well as a satisfactory tightness, as is required in the automobile construction.

The object of the invention is an expansion tank and water box device for a heat exchanger with a nest of parallel tubes, such as the radiator of a motor vehicle, which remedies such disadvantages. It comprises a water box housed inside the expansion tank and maintained by the assembly of the latter with a hollowed plate through which extend the ends of the tubes, and characterized in that ribs are interposed between the water box and the expansion tank.

With such a device, the compensation chamber may not only have an important volume, but the same type of water box can also be used for making cooling radiators for engines of various ratings.

Advantageously, the ribs are such as to provide the required rigidity for the expansion tank.

For making the water box, one may use a material, particularly a plastics material, of current mechanical characteristics.

An object of the invention is in particular horizontal tube exchangers in which a large cross-section passage of communication is provided between the collecting chamber and the compensation chamber, at the lower portion of the latter, whereas at the upper portion, the communication is established through an opening of small cross-section.

A further object of the invention is to provide embodiments wherein the expansion tank and water box device can be manufactured from a moldable plastics materials such as is currently available in the industry and the configurations of which are adapted for allowing a low cost molding operation. By having the ribs depending from the summit portion of the expansion tank, the various portions of the device are well adapted to the efforts which they may be subjected to, due to the inner pressure, while ensuring the tightness of the assembly through simple means.

An object of the invention is also an embodiment according which the filling tubing of the expansion tank is a cylinder the inner surface of which is the continuation of the summit portion of the tank and is characterized in that the expansion tank is formed with side walls which, in their outer portions, are closer to each other than in their inner portion, the water box coming to bear against the expansion tank at the junction between the wall portions.

The invention will become more apparent from the following description, reference being made to the accompanying drawings wherein.

Reference is first made to FIGS. 1 to 5.

Figure 3:
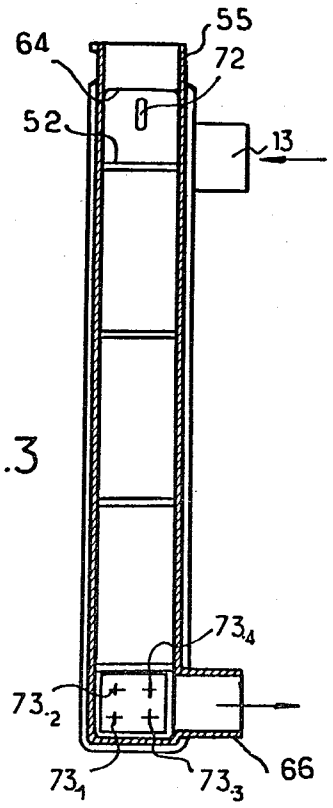
FIG. 3 is a sectional view along line 3—3 of FIG. 2.
Figure 2:
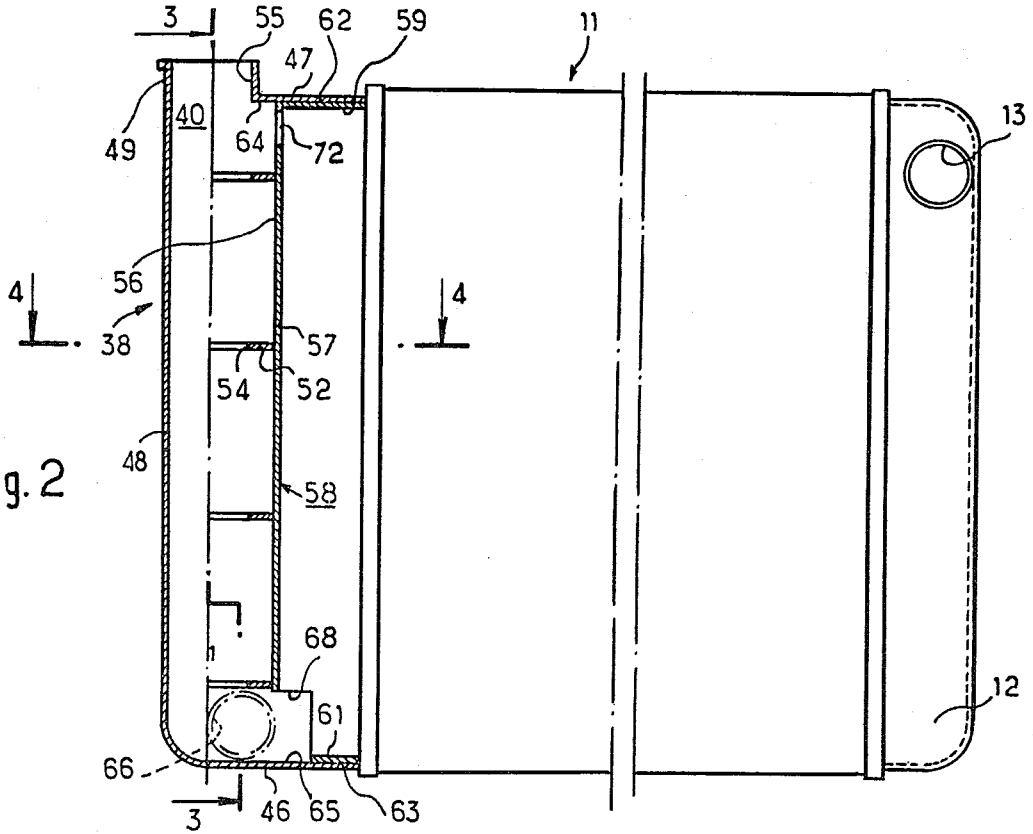
FIG. 2 is an elevation view in cross-section along line 2—2 of FIG. 1.
Figure 1:
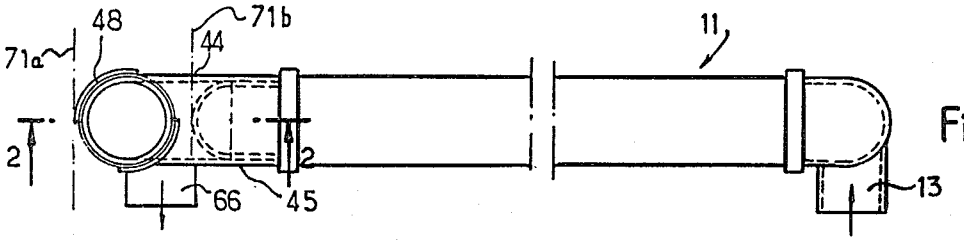
FIG. 1 is a plan view of a radiator with so-called I-shaped fluid circulation, according to the invention.

The radiator comprises a nest 11 (FIGS. 1 to 3) of horizontal tubes 15 (FIG. 4) in which flows the water to be cooled and which extend with contact through the ribs 9 swept by the air. In FIGS. 1 and 2, the tubes 15 have not been shown in detail.

At one end, the tubes 15 emerge into a water box 12 (on the right hand side in FIG. 2), from which depends a pipe 13 through which arrives the liquid to be cooled.

Figures 4, 5:
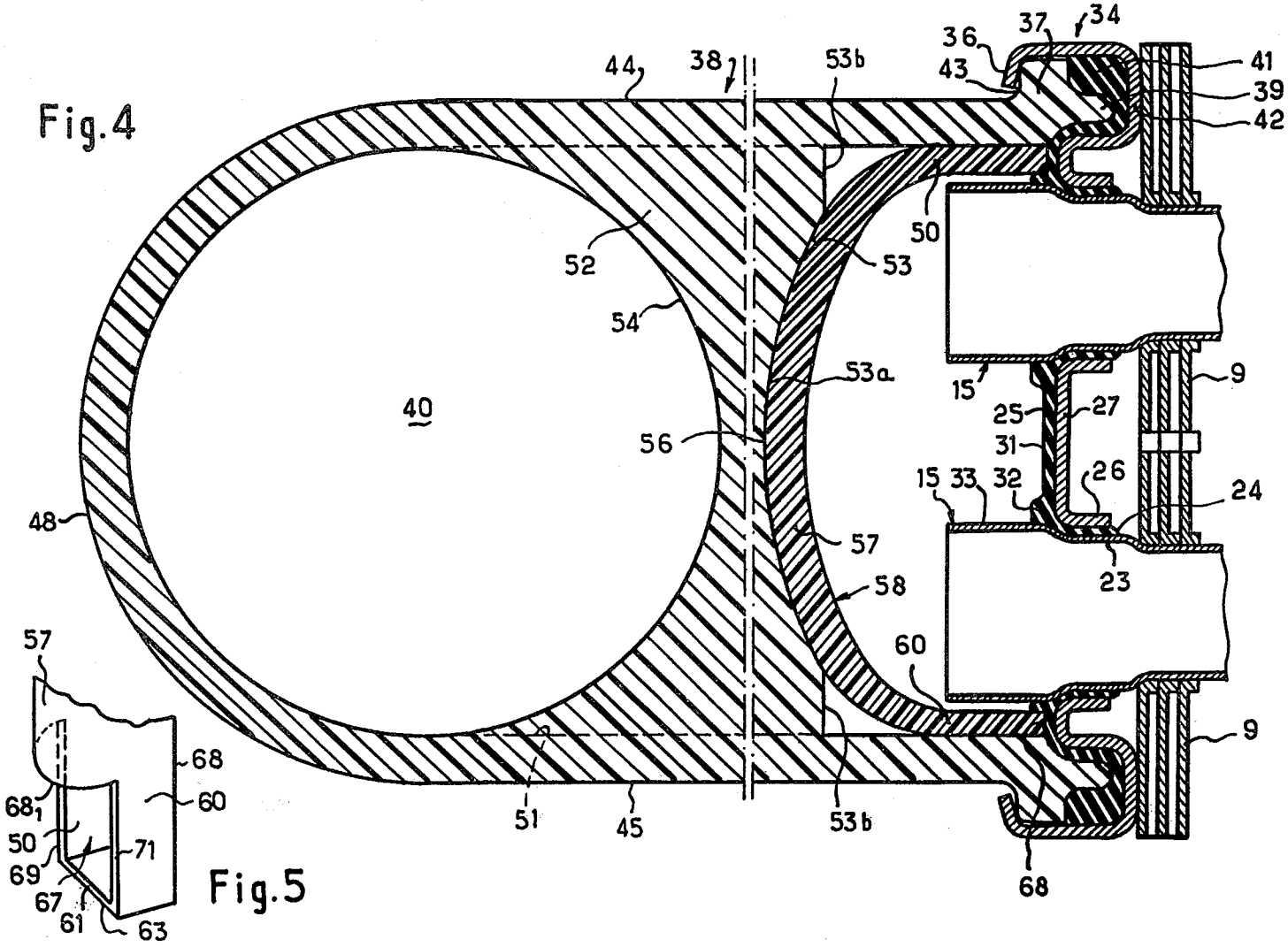
FIG. 4 is a sectional view at a larger scale along line 4—4 of FIG. 2.
FIG. 5 is a partial perspective view of the base of the water box which is part of the device shown in FIGS. 1 to 4.

Said water box 12 comprises a hollowed plate or manifold, for instance metallic, through extend the tubes 15 with which it is assembled, in a manner known per se, for instance as is shown in FIG. 4 for the opposite ends of the tubes.

At their other ends (on the left hand side in FIG. 2), the tubes 15 are formed with a first cylindrical widened portion 23 (FIG. 4) pressing a flanged portion 24, depending from a leaf 25 made of an elastomeric material or similar, against an edge 26 of the hollowed plate or manifold 27. The outer face 31 of the leaf 25 is advantageously formed with beads 32 cooperating with a tight fit with a second widened portion 33 forming the end of tube 15.

In an alternative embodiment, the assembly of the tubes with a hollowed plate is provided with a force fit.

The manifold 27 comprises a peripheral channel 34 of general U-shape in cross-section, formed with crenels carrying lugs 36; said lugs are provided, by having their end folded over, for maintaining with a tight fit a beading 37 forming the edge of an expansion tank 38, advantageously in plastics material. The beading 37 is formed with a bead 39 engaging a margin 41 of seal 25, the margin 41 coming to bear against the bottom 42 of a channel 34, the lugs 36 biasing the beading 37 by being applied against a shoulder 43 of the latter. Thus is formed a tight assembly between the manifold 27 and the expansion tank 38.

The expansion tank 38 is limited by two vertical walls 44 and 45 (FIGS. 1 and 4) connected by horizontal walls, respectively a lower wall 46 and an upper wall 47, and by a semi-cylindrical vertical bottom 48. From the upper horizontal wall 47 depends a pipe 49 having means for positioning a clapper-valve, not shown, provided for communicating the compensation chamber 40 of the expansion tank 38 with the air if its pressure is different, above or below, of the atmospheric pressure, by pre-determined value(s).

From the inner surface 51 of the expansion tank 38 depend parallel plane ribs 52 connecting between themselves the two vertical walls 44 and 45. Said ribs have a configuration the general shape of which is that of a diabolo (FIG. 4). They are limited by an inner edge 54 which is semi-circular and an outer edge 53 having a central portion 53*a* in the shape of a concave curve and rectilinear ends 53*b* and 53'*b* perpendicular to walls 44 and 45. The edge 54 is substantially in the prolongation of the inner surface 55 of the tubing 49 (FIG. 2).

In the concave portion 53*a* of edge 53 of the rib 52 is housed the outer surface 56 of the vertical ceiling 56 of a water box 58 limited by two upper 59 and lower 61 horizontal walls, the outer surfaces 62 and 63 of which (FIGS. 2 and 5) are in contact with the inner surfaces 64 and 65 of walls 47 and 46 of the expansion tank 38, and through two other vertical walls 50 and 60 (FIG. 4) depending from ceiling 57.

As an alternative, the ceiling of the water box is plane and applied against rectilinear ridges of the ribs of the expansion tank.

From the vertical plane wall 45 of the expansion tank depends a pipe 66 (FIG. 1) for the assembly of a hose extending towards the suction side of the water pump (not shown).

The ceiling 57 and the side vertical walls 50 and 60 of the water box 58 as well as the lower horizontal wall 61 are indented (FIG. 5) in the shape of a window or indentation 67 having a curvilinear upper edge $68_1$ and vertical side edges 69 and 71.

When the expansion tank 38 is assembled with the manifold 27, the outer edges 53 of the ribs or partition walls 52 depending from the expansion tank bias the water box 58 against the manifold 27 via its peripheral edge 68 which is applied under pressure against the elastomeric leaf 25 and provides thus the tightness of the water box relative to the hollowed plate or manifold 27.

The expansion tank 38 which, preferably, is made of a plastics material or of aluminium, is advantageously obtained by molding and the invention foresees that the inner edges 54 of the various ribs 52 are in relief so as to provide an easy removal from the mold relative to the punches or cores of the mold used for the manufacture of the tank. During the removal from the mold, one of the cores is moved vertically through the filling opening provided by the pipe 49 and the other core, which was used in particular for forming the ribs 52, is extracted horizontally by the open end of the expansion tank which is opposite the semi-cylindrical bottom 48.

Said ribs 52, which are stiffening ribs, contribute to the rigidity of the expansion tank 38 and provide it with a good mechanical strength, particularly when the water is under pressure.

A passage 72 in the shape of a buttonhole is provided in the ceiling 57 of the water box (FIGS. 2 and 3), at its upper portion, in the vicinity of wall 59. Said passage is of a cross-section which is much smaller than the indentation 67, and this is favourable to the degassing operation, thereby providing a good operation of the collecting chamber-compensation chamber assembly, as will be seen hereafter.

The water box 58 may be made with a thin wall, for instance by molding of a plastics material of current mechanical features, and have nevertheless the required mechanical strength, and this particularly by the intervention of the partition walls or ribs of the expansion tank with which they cooperate.

For meeting different conditions which various radiators have to comply with, according particularly to the power of the vehicle which they have to equip, one may foresee expansion tanks distinct from each other by their height, that is the distance between the summit plane 71*a* (FIG. 1) and the semi-cylindrical wall 48 and the summit plane 71*b* of the water box, the water boxes remaining with the same sizes, the device having thus compensation chambers of different volumes, a compensation chamber being the space inside the expansion tank but outside the water box. In other words, one may use water boxes of determined sizes, viz. "standard" sizes, for various types of vehicles, the height of the expansion tank being the only one to vary as a function of the power of the vehicle engine. For expansion tanks of different heights, the edges 54 of the ribs 52 remain in the prolongation of the cylindrical inner surface 55 of the tubing 49 the cross-section of which remains substantially constant; in this case, the height of the ribs is therefore variable.

The assembly of the device is extremely simple and is the one which is frequently used for the assembly of water boxes.

During operation, the water which fills the space limited by the water box 58 and the hollowed plate 17, or collecting chamber, flows at a reduced rate through the buttonhole 72 in the compensation chamber 40. At the lower portion of said chamber, the water leaves it through pipe 66 together with the water arriving directly from the collecting chamber and also that arriving from the tubes the axes of which are shown at $73_1$, $73_2$, $73_3$, $73_4$ (FIG. 3) opposite the indentation 67 of the water box. As is already known per se, it is the fact that the buttonhole 72 has a section more reduced than the indentation 67 which allows that the degassing, that is the separation of the air from the water, is effected in the upper portion of the compensation chamber 40 which is free of liquid. Said chamber 40 allows also that the expansions the liquid do not damage the installation.

The device is usable for equipping radiators in which the water flow is in one direction only (radiators of the I fluid circulation type) as well as for those where the water flows in the two directions (for example in radiators of the Z circulation type).

Figure 8:
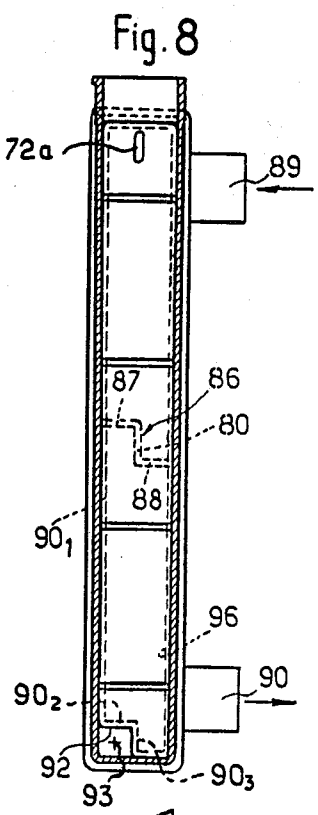
FIG. 8 is a sectional view along line 8—8 of FIG. 7.
Figure 7:
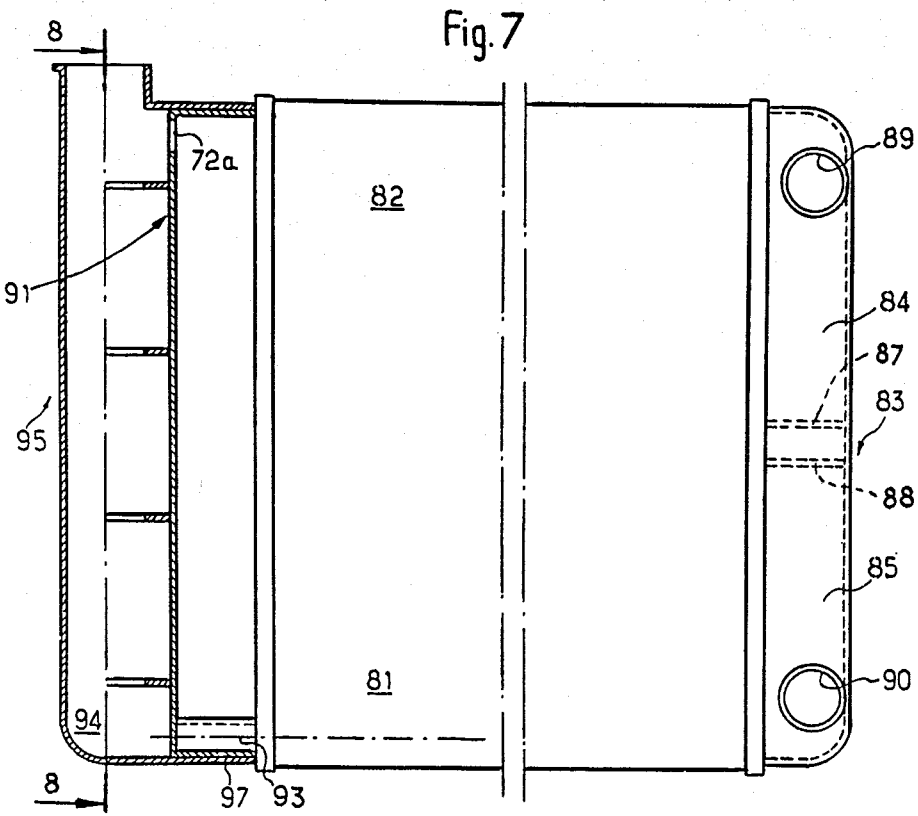
FIG. 7 is an elevation view and partly in cross-section along line 7—7 of FIG. 6.
Figure 6:
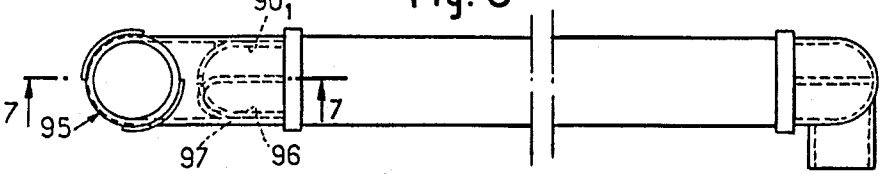
FIG. 6 is a view similar to FIG. 1, but for another embodiment of a heat exchanger, viz. for an exchanger of the so-called U-shaped fluid circulation.

Reference is now being made to FIGS. 6 to 8 relative to another embodiment in which the flow of the fluid is in the shae of a U, viz. in both ways of the same direction.

The nest of radiator tubes comprises a first lower group 81 and a second upper group 82 (FIG. 7). One of the water boxes 83 is divided into two compartments 84 and 85 by a partition wall 86 of transverse cross-section in the shape of a Z with horizontal bases 87 and 88 and a vertical line 80 (FIG. 8). In the upper compartment 84 and lower compartment 85 emerge respectively the inlet tubing 89 and the outlet tubing 90. The flow of water is in the reverse direction in each of the groups 81 and 82 of the tubes.

Figure 9:
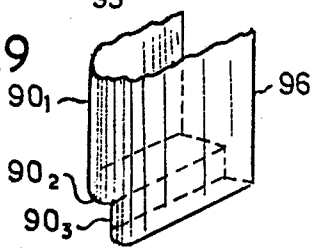
FIG. 9 is a perspective view of the lower portion of the water box.

In this embodiment, a vertical wall $90_1$ of the other water box 91 is formed with a step 92 (FIG. 8) limited by a horizontal face $90_2$ and a vertical face $90_3$ (FIG. 9) leaving the opening of a lower tube of axis 93 unmasked, of the lower group of tubes 81, unmasked for the free communication of the compensation chamber 94 will the lower compartment 85 and to provide thereby the degassing of the water it contains. The other vertical wall 96 of the water box 91 is applied against its whole height against the ajoined wall 97 of the expansion tank 95. As in the previous embodiments shown in FIGS. 1 to 5, a passage 72*a* of cross-section more reduced than that provided in the step 91 is provided in the ceiling of the water box in the vicinity of the filling plug.

Figures 10, 11, 12, 13:
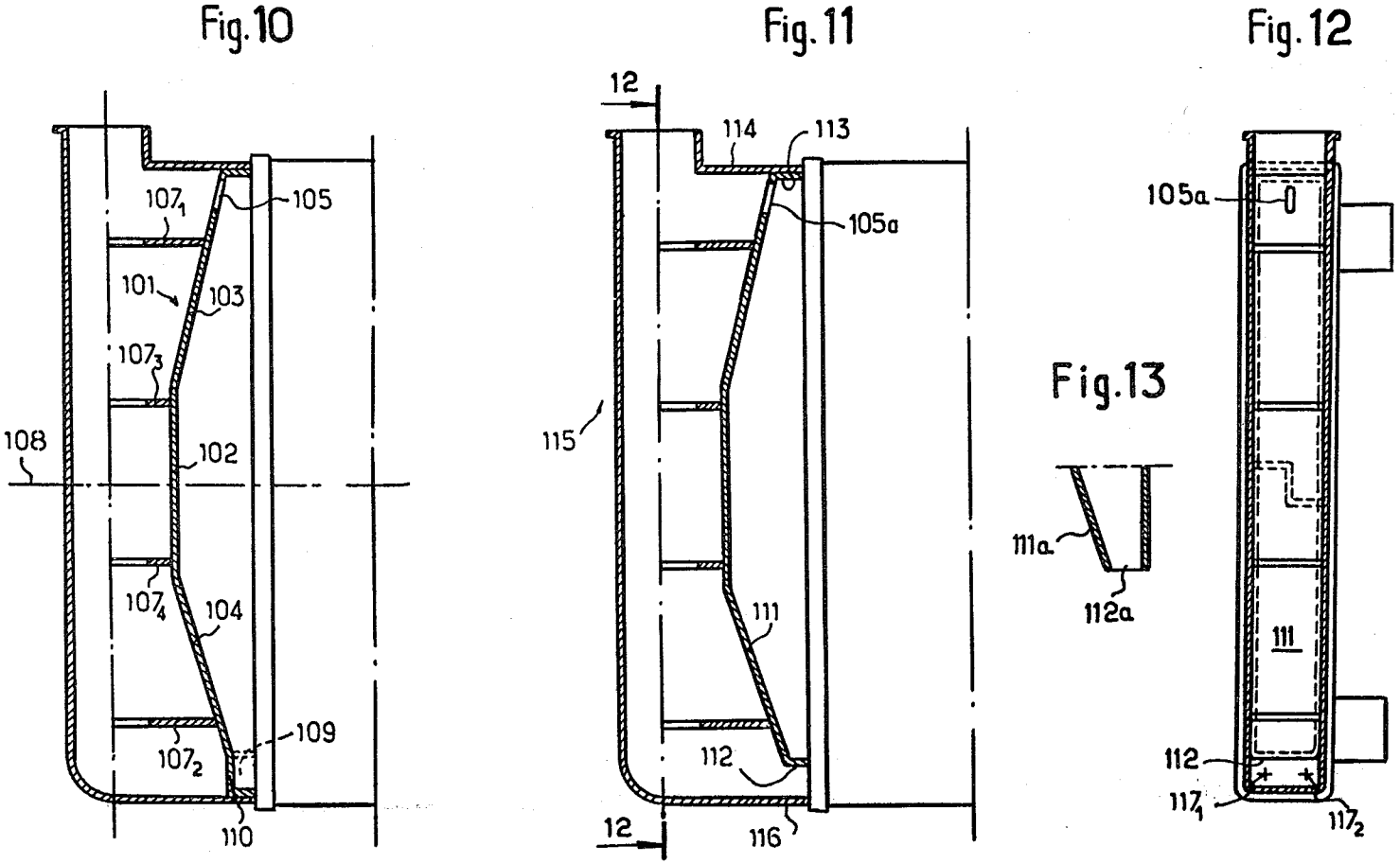
FIG. 10 is a view similar to that of FIG. 7, but for another embodiment and for a portion only thereof.
FIG. 11 is a view similar to that of FIG. 10, but for another embodiment.
FIG. 12 is a sectional view along line 12—12 of FIG. 11.
FIG. 13 shows in cross-section the base of a water box for another embodiment.

Reference is now being made to FIG. 10. In the radiator equipped with the device according to this embodiment, the water circuit is the same as that of the previous embodiment. However, the ceiling of the water box 101 comprises a summit portion 102 which is plane, parallel to the manifold or hollowed plate, flanked on either side with two oblique portions 103 and 104, also plane. It is on the upper oblique portion 103 that the opening 105 is provided for the degassing.

The horizontal transverse sections of the water box 101 are well adapted to the flow rate of the water flowing at various heights in said box and the volume of the expansion tank is increased.

The ribs or partition walls $107_1$ and $107_2$ cooperating with the portions of oblique walls 103 and 104 remote from the medium horizontal plane 108, are longer than the ribs $107_3$ and $107_4$ closer to said plane, which facilitates the positioning in a vertical direction of the water box in the expansion tank. The step 109 of the water box, in order to leave the opening of a lower tube free, is opposite a portion of the vertical wall 110.

In the embodiment shown in FIGS. 11 and 12, the configuration of the ceiling of the water box is similar to that of the embodiment previously described, but the lower oblique wall 111 is connected to a marginal wall 112, similar to the upper marginal wall 113 applied against the upper central wall 114 of the expansion tank 115, but which is remote from the lower wall 116 of said expansion tank in order to leave uncovered the openings of the lower tubes of the two rows the axes of which are shown at $117_1$ and $117_2$ (FIG. 12). The water box which is maintained in a vertical position due to the ribs of the expansion tank is therefore of a height which is lower than that of the expansion tank.

As an alternative (not shown), the wall 112 is remote from the wall 116 in order to leave uncovered the openings of four lower tubes instead of two.

In a further alternative, the wall 112 is omitted, leaving an opening 112*a* (FIG. 13) at a distance from the lower wall of the expansion tank (not shown in FIG. 13). Of course, in this case, one has to chose the cross-sections of the openings 105*a* and 112*a* so as to ensure the proper operation of the installation.

Figure 16:
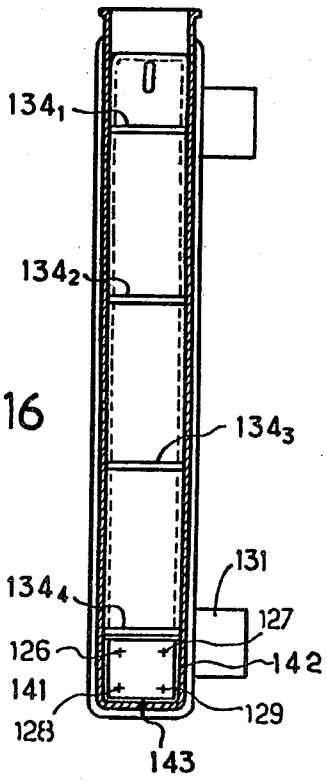
FIG. 16 is a sectional view along line 16—16 of FIG. 15.
Figure 15:
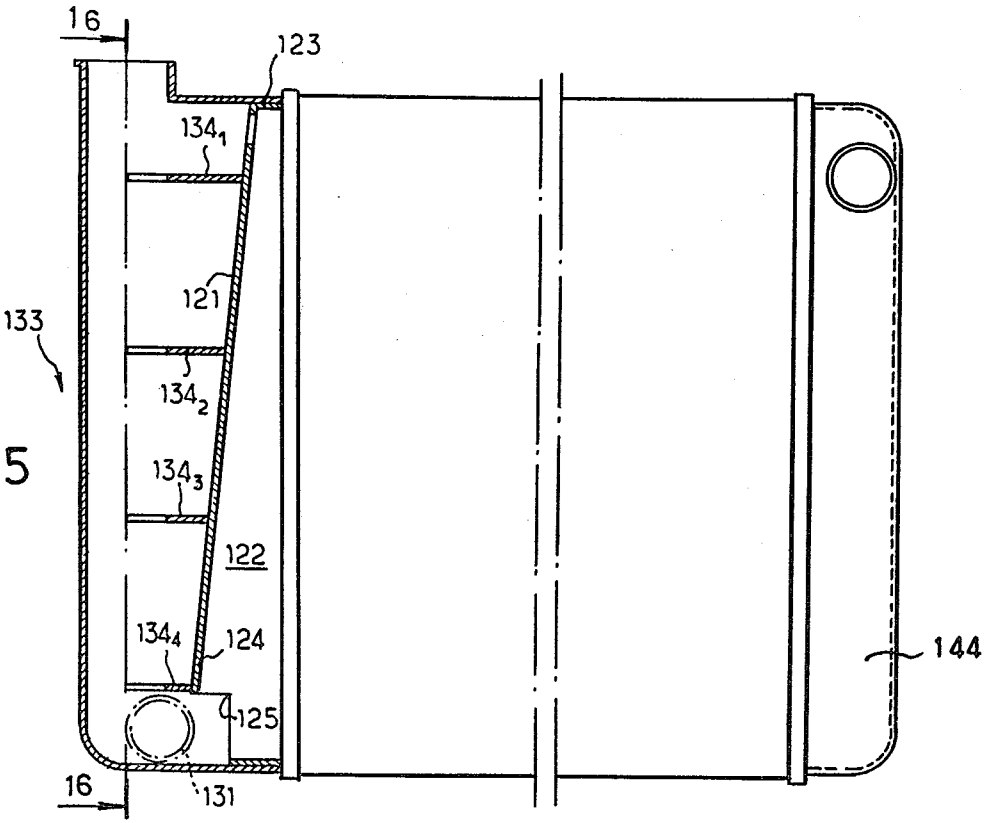
FIG. 15 is an elevation view in cross-section along line 15—15 of FIG. 4.
Figure 14:
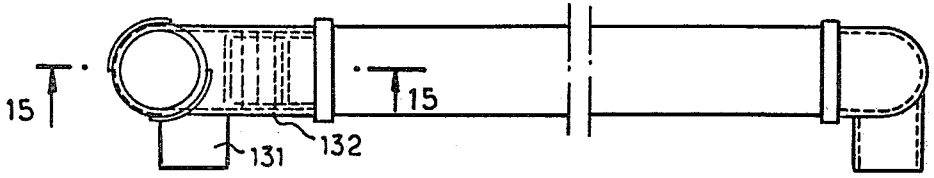
FIG. 14 is a view similar to that of FIG. 1, but for another embodiment.

In the embodiment shown in FIGS. 14 to 16, the ceiling 121 (FIG. 15) of the water box 112 is inclined in a single direction from the upper end 123 to the lower end 124. This disposition provides passage sections which are favourable to the flow of the liquid (the radiator is of the I type) and moreover permits increasing the volume of the compensation chamber. An indentation 125 of the ceiling 121 of the vertical walls 141 and 142 and of the lower wall 143 unmask the openings of four lower tubes of the nest, the axes of which are respectively at 126, 127, 128, 129 for a direct communication between the opposite water box 144 with the lower tubing 131 provided on the vertical wall 132 of the expansion tank 133. The ribs $134_1$, $134_2$, $134_3$ and $134_4$ are of decreasing length from top to bottom for adapting themselves to the inclination of the ceiling 121 of the water box 122.

In all these embodiments, the contour of the ribs provides the removal from the mold by the plug and the open bottom of the expansion tank.

The ribs contribute to the rigidity of the expansion tank and form bearings for the water box and thus allow meeting the efforts developped by the water under pressure or depression. So, the expansion tank can meet the efforts arising from the "breathing" of the radiator.

Figure 17:
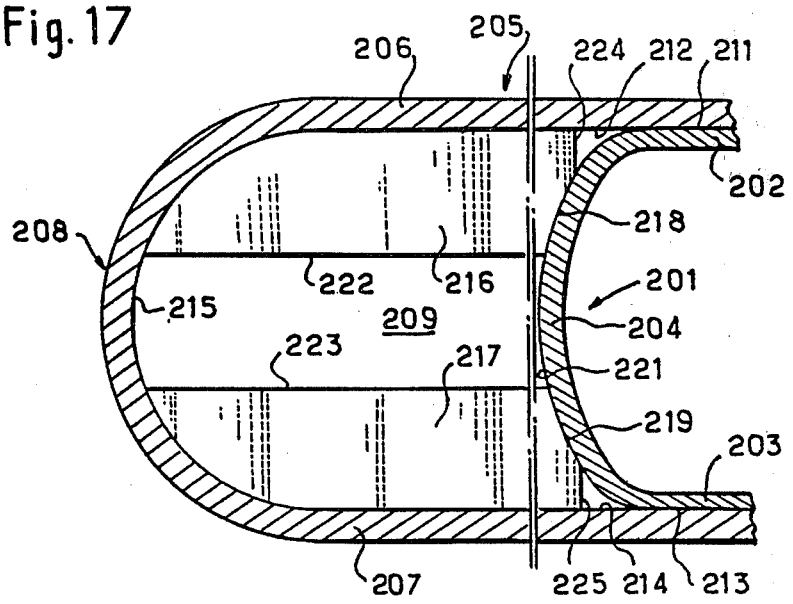
FIG. 17 is a partial horizontal cross-sectional view of an expansion tank and water box device.

In the embodiment shown in FIG. 17, the water box 201 has, in a transverse cross-section, two parallel edges 202 and 203 substantially plane and connected by a curved ceiling or dome 204. The expansion tank 205, which has the general shape of a cylindrical sleeve, is formed with two parallel plane walls 206 and 207 connected by a ceiling or dome 208 with an inner surface 215 and having a transverse cross-section in the shape of a semi-circular ring. The expansion tank 205 defines with the water box 201 a compensation chamber 209. The outer surface 211 of the edge 202 of the water box is joined to the inner surface 212 of the wall 206 of the expansion tank 205 and the other surface 213 of the edge 203 is joined to the inner surface 214 of wall 207.

From the inner surface 212, 214, 215 of the expansion tank 205 depend transverse walls or ribs arranged in two rows 216 and 217, the inner edge of which, respectively 218 and 219, corresponding to the profile of the outer surface 221 of the water box ceiling 204.

Said walls which fulfill a stiffening function for the walls 206, 207 and the ceiling or dome 208 limiting the expansion tank 205 provide the latter with a good mechanical behaviour, particularly when the water is under pressure, by resisting efficiently to transverse deformations of the walls 206 and 207. They do not interfere with the circulation of the water in the compensation chamber 209, the gap provided between the registering edges 222, 223 of the walls 216, 217 leaving a sufficiently free passage for the water in circulation, even when starting the motor driving the pump circulating the water in the heat exchanger. The truncated portions of the walls 216 and 217 follow rectilinear edges 224 and 225 prevent the latter from having fragile areas.

The expansion tank 205 is obtained by molding a plastics material or a light alloy. The walls 216, 217 are obtained by the same molding operation as the walls 206, 207, 208 of the expansion tank, the movement of the two parts of the mold, for the molding and removal from the mold, being parallel to walls 206 and 207.

Further to their stiffening function, the walls 216, 271 bias the water box 201 against the manifold or hollowed plate (not shown in FIG. 17) when the expansion tank is joined to said manifold through which extend the ends of the tubes emerging into the collecting chamber which is limited by the water box, as previously described.

Figure 18:
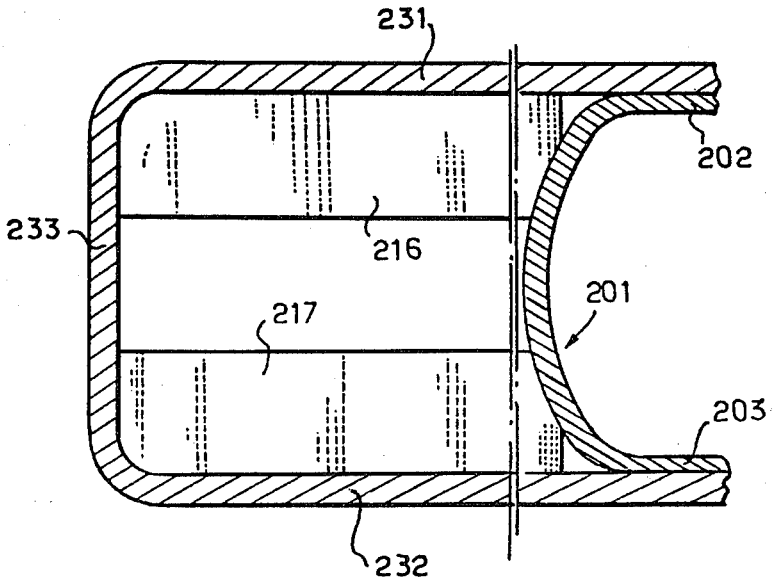
FIG. 18 is a view similar to that of FIG. 17, but of an alternative embodiment.

The embodiment shown in FIG. 18 is similar to that just described. However, in this embodiment, the expansion tank has the shape of a right-angled parallelepiped, the two parallel walls 231 and 232 being joined by a perpendicular wall 233.

Figure 19:
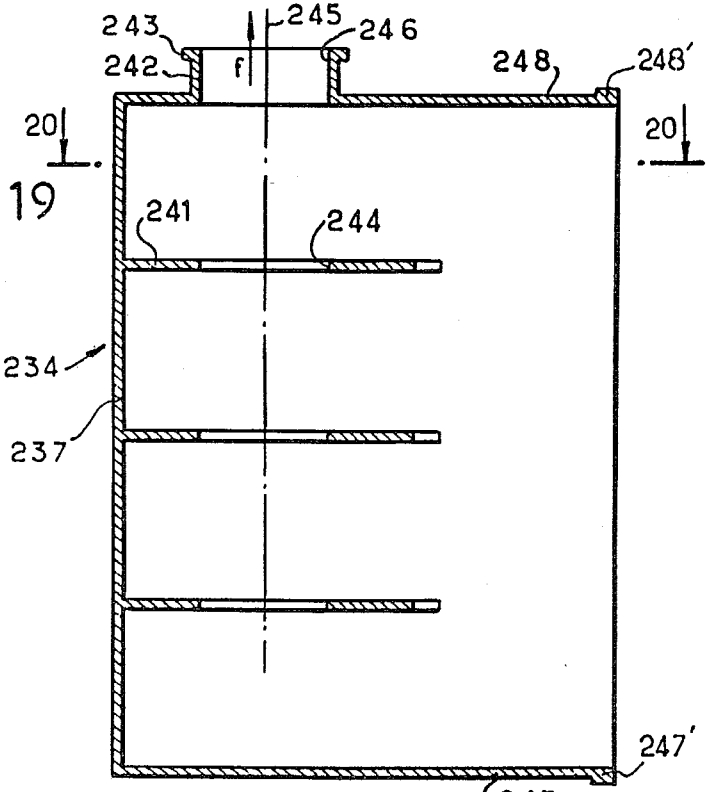
FIG. 19 is a vertical cross-sectional view of an expansion tank which is part of a device according to the invention.
Figure 20:
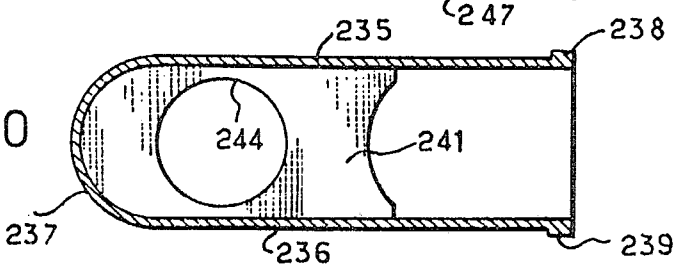
FIG. 20 is a sectional view along line 20—20 of FIG. 19.

Reference is now made to FIGS. 19 and 20. In this embodiment, the expansion tank 234 has, as in the embodiment shown in FIG. 17, a general parallelepipedal shape with two parallel walls 235 and 236 connected by a semi-cirular cylindrical wall 237; the walls 235 and 236 ending into margin beads 238 and 239. The stiffening walls or ribs 241 extend from the wall 235 to the wall 236 and are formed, opposite a cylindrical mouth-piece 242, having an edge 243, for receiving the automatically opening and closing clappervalve, with openings 244 of same axis 245 as said mouth-piece and of same diameter as the inner surface 246 of the latter.

The mouth-piece 242 and the openings 244 are formed during the molding operation by the same core which, when removed from the mold, is extracted by following a movement in the direction of arrow f. The eventual deformations of the core, under the effect of the very high molding pressures, have no influence on the thickness of the semicylindrical wall 237.

The mold elements allow, through a single molding operation, the manufacture of the expansion tank, including its bottom wall 247 and its upper wall 248 with their peripheral beads 248' and 247'.

Figure 21:
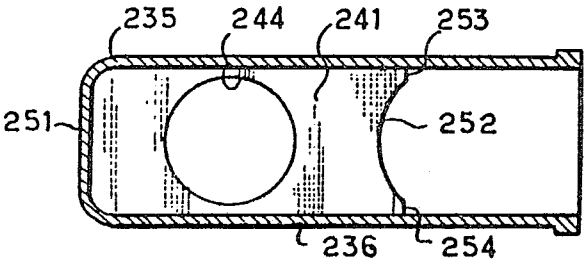
FIG. 21 is a view similar to that of FIG. 20, but of another embodiment.
Figure 22:
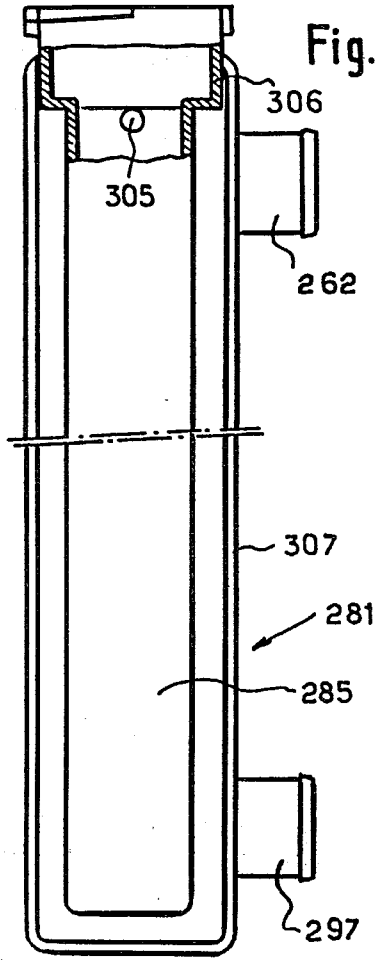
FIG. 22 is a front view of a device according to the invention, with parts cut out.
Figure 23:
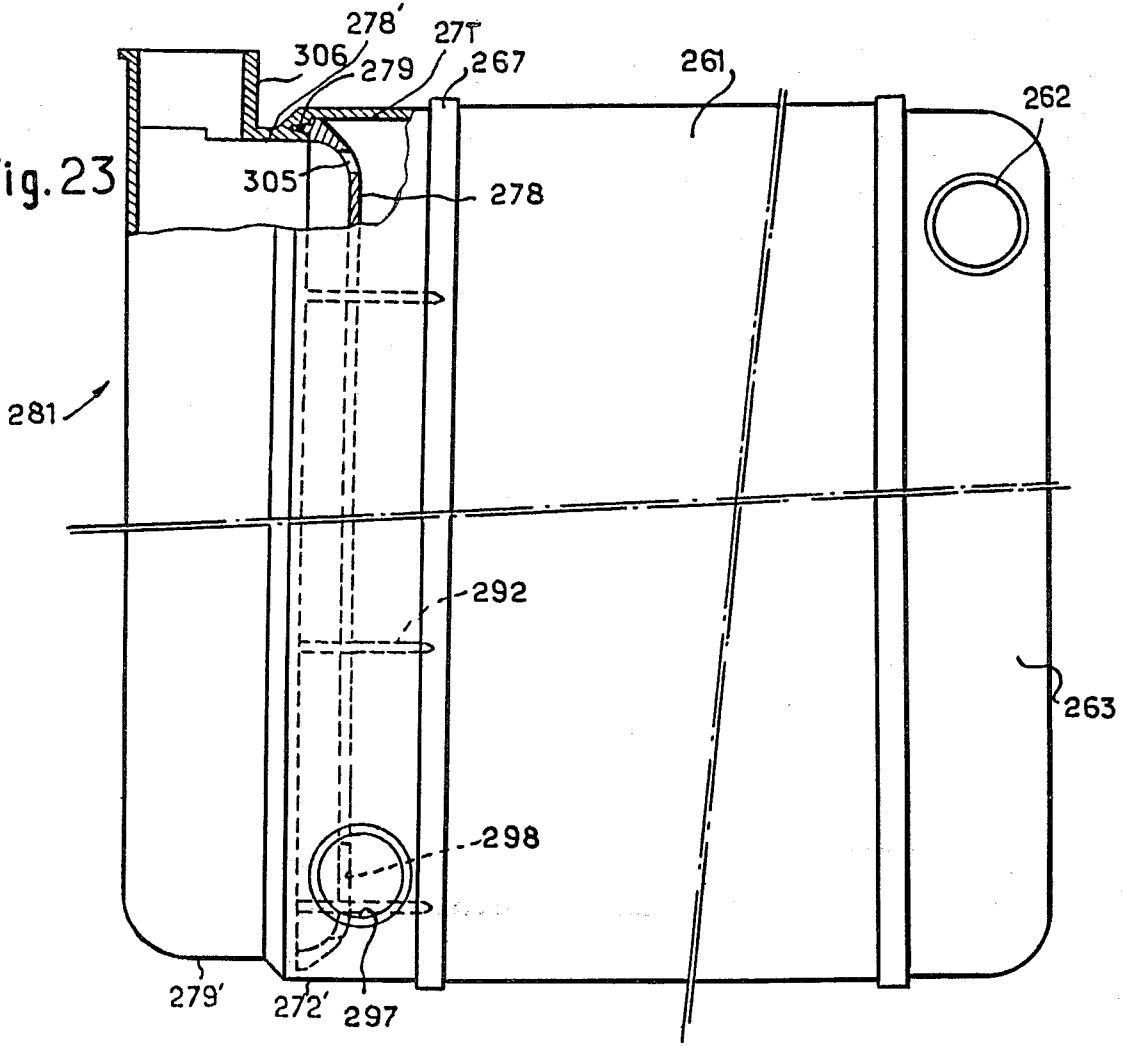
FIG. 23 is an elevation view, at an angle of 90° to the preceeding view, also with parts cut out.
Figures 24, 25, 26:
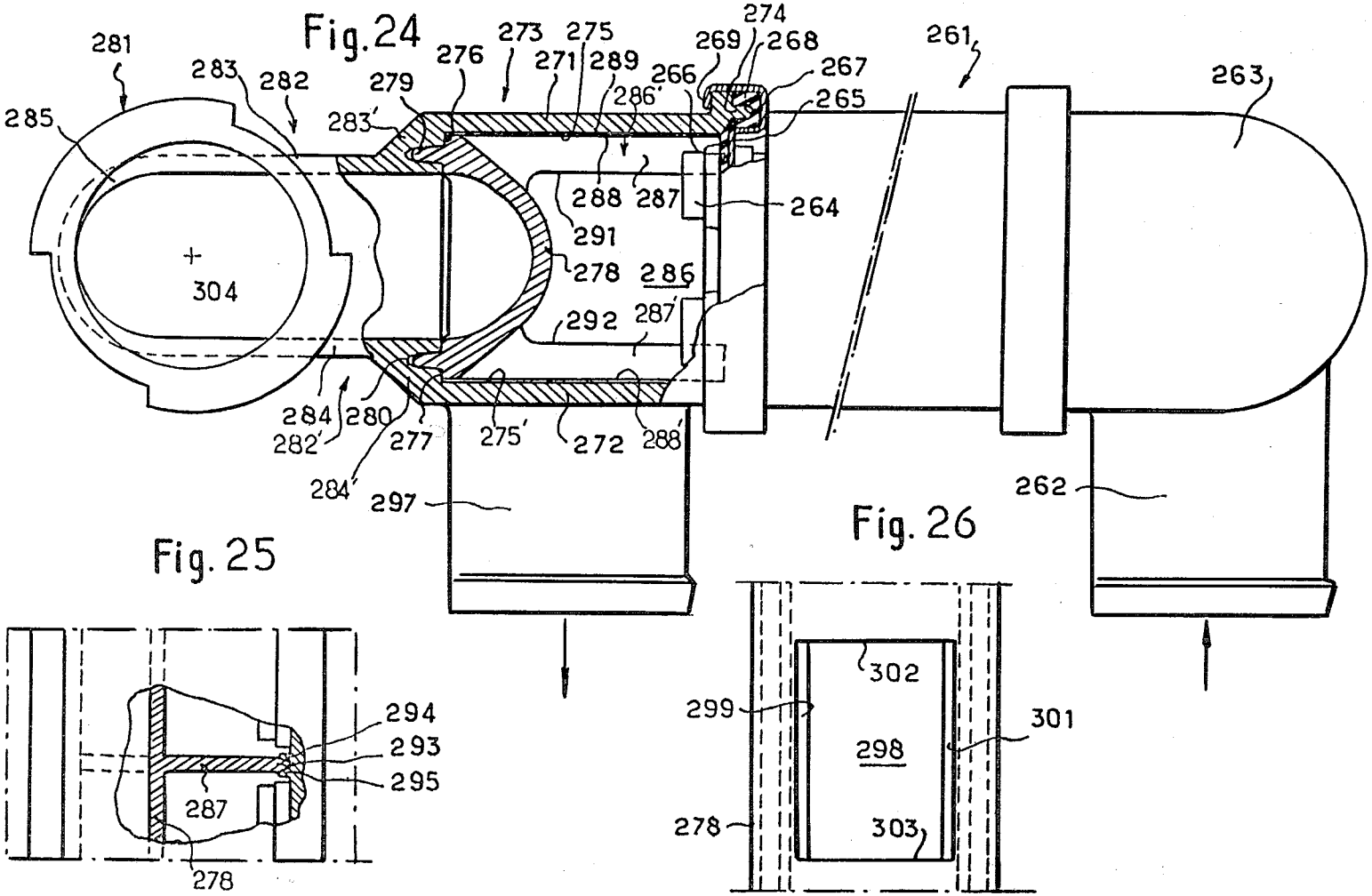
FIG. 24 is a plan view at a larger scale with parts cut out.
FIG. 25 is a partial elevational view, also at a larger scale, with parts cut out.
FIG. 26 is a view corresponding to that of FIG. 25 but at an angle of 90° to the latter.

In the alternative embodiment according to FIG. 21, the expansion tank has the shape of a rectangle parallelepiped, by analogy with the embodiment shown in FIG. 18, with its wall 251 perpendicular to walls 235 and 236 and from said walls depending, as in the previous embodiment, walls 241, with an opening 244 and an edge having a curvilinear portion 252 conjugated with the dome of the water box, and rectilinear portions 253 and 254.

Reference is now being made to FIGS. 22 to 26. In this embodiment, the nest 261 of tubes 264 for the circulation of the water is fed with water through a tube 262 depending from a first water box 263. Said tubes 264 (FIG. 24) extend, through their ends opposite the water box 263, through a manifold or hollowed plate 265 and are tightly connected to the latter through an elastomeric plate or leaf 266. The hollowed plate 265 has an edge 267 in the shape of a gutter in which is housed a beads 268 forming the periphery of the elastomeric leaf, and folded lugs 269 of the manifold edge 267 apply with a pressure against said periphery the edge 274 forming the end of the portions of parallel walls 271 and 272 depending from a receptacle 273 of general parallelepipedal shape, as well as the edge of respectively upper and lower perpendicular walls 271' and 272'. Thus is provided a tight assembly between the hollowed plate 265 and the receptacle 273.

The receptacle 273 has vertical walls 282, 282' which, further to the wall portions 271 and 272, have wall portions 283 and 284, also parallel, but closer to each other than are the wall portions 271 and 272, to which they are connected via connecting portions 283' and 284'. The respectively upper and lower wall portions 278' and 279' which limit the compensation chamber are closer to each other than the wall portions 271' and 272' limiting the collecting chamber.

The wall portions 271 and 272 and the perpendicular walls 271' and 272' are each formed on their inner face 275 with a shoulder or rib 276 adapted for the support of a corresponding shoulder 277 which is part of a curved cover 278 the convexity of which is turned towards the manifold 265, and which extends into a lip 279. The latter is introduced into a groove 280 of the connecting portions 283', 284' and of a similar groove, provided on the inner surface of the upper and lower walls of receptacle 273. The parallel vertical walls 283 and 284 are connected by a semi-circular cylindrical wall 285.

From the curved cover 278 depend in its marginal portions pairs of walls 287, 287' the front and rear edges 288 and 288' of which can bear against the inner surface 275, 275' of walls 271 and 272, the inner edges 291 and 292 of the walls being parallel to edges 288, 288'. The pairs of walls, three in number in the example shown, end into a bevelled edge 293 (FIG. 25) adapted for engaging, in view of a pre-positioning, lips 294 and 295 formed on the elastomeric leaf 266. The water outlet tube 297 depends from the side wall 272 of the expansion tank 273.

In this embodiment, the collecting chamber 286 is limited, in addition to the hollowed plate 265 and the curved cover 270 forming its summit wall, by vertical wall portions 271, 272, and the horizontal wall portions 271' and 272'.

The compensation chamber is limited by the vertical wall portions 283 and 284 and the semi-circular cylindrical wall 285, the horizontal walls 278' and 279' as well as the curved cover 278.

The assembly of the receptacle 273 with the hollowed plate 265 folding over the lugs 269 of edge 267 of the latter provides simultaneously the fixation of what can be considered as the water box 286' limiting the collecting chamber and the fixation of what may be considered as the expansion tank 281 limiting the compensation chamber. The expansion tank 281 applies thus, through the rib 276, 277, the water box 286' against the hollowed plate 265 through the elastomeric leaf 266.

The cooperation of the ribs or shoulders 276 and 277 provides a sufficiently tight assembly between the water box 286' and the expansion tank 281.

The bearing of the walls 287 against the hollowed plate or manifold 265 through the elastomeric leaf 266 provides, by reaction, a good cooperation between the peripheral lip 279 of cover 278 and the groove 280 of the expansion tank 273 of which it is engaged, the walls 287 being distributed over the whole height of the water box.

At its lower portion, the cover 278 is formed with a rectangular window 298 (FIG. 26) with longitudinal edges 299, 301 and transverse edges 302 and 303 for communicating with the collecting chamber 286 and the compensation chamber 304.

At its upper portion, the cover 278 is formed with a small opening 305 (FIGS. 22 and 23) for communicating the upper portion of the collecting chamber 286 with the upper portion of the compensation chamber 304. The expansion tank carries a mouth-piece 306 for receiving the usual calibrated clapper.

The operation of this embodiment is identical to that of the previously described embodiments.

Figure 27:
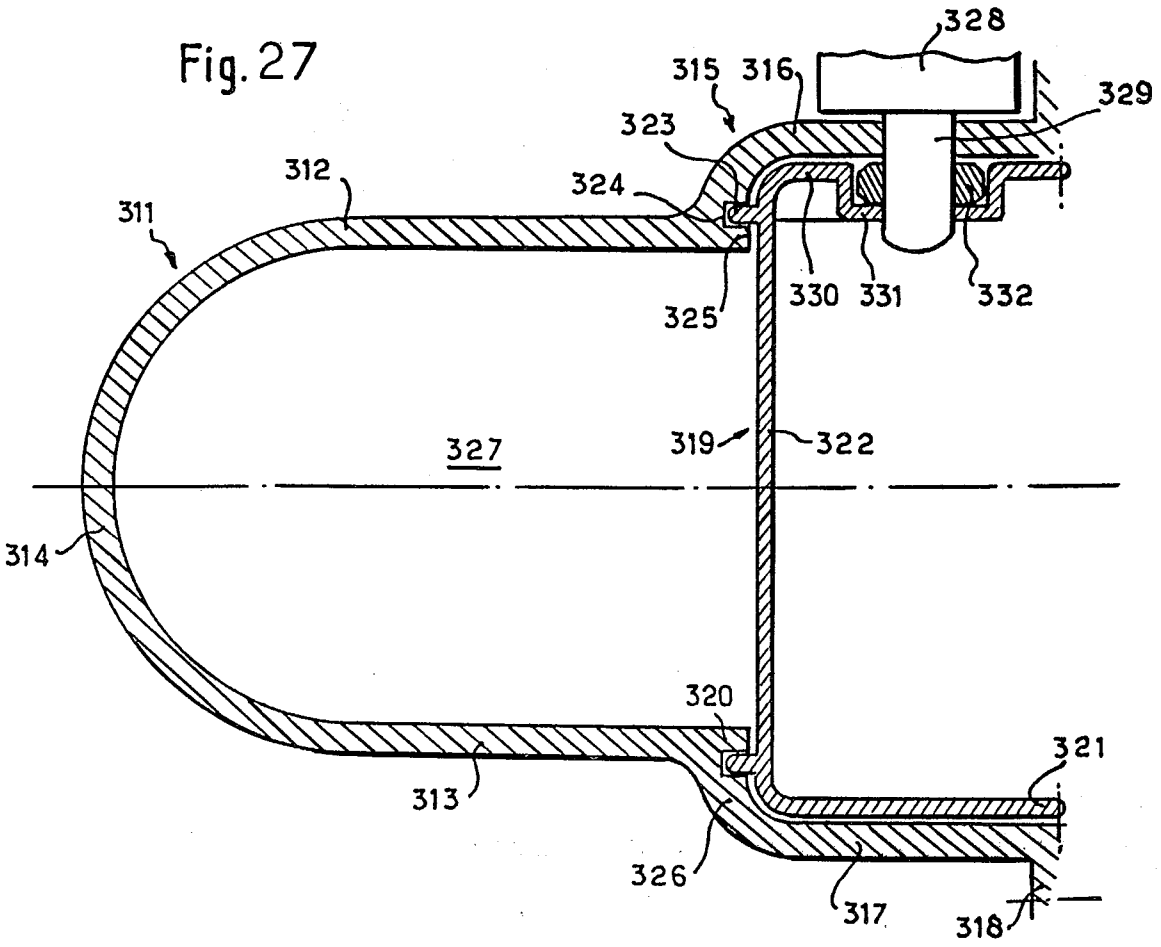
FIG. 27 is a schematic cross-sectional view of a tank and water box device.

Reference is now being made to FIG. 27. In this embodiment, the expansion tank 311, of general parallelepipedal shape, has two large parallel vertical walls 312 and 313 connected by a semi-cylindrical wall 314. The expansion tank 311 ends opposite the semi-cylindrical portion 314 into a flared out portion 315 limited by walls 316 and 317 ending into a peripheral beads 318 for a tight assembly of the hollowed plated or manifold, not shown in the FIG. 27.

The flaring out portion 315 surrounds a water box or cover 319, of general rectangular parallelepipedal shape, the opening edge 321 of which engages the elastomeric leaf for contributing to the tightness, as previously described. The plane summit wall 322 of the water box 319 is formed at its periphery with a rib 323 of rectangular configuration, and said rib is engaged into a groove 324, of conjugated transverse cross-section and corresponding configuration, formed on the inner surface 325 of the expansion tank, in its connecting portion 326 between the compensation chamber 327, limited by the expansion tank 311 and the bottom 322 of the water box, and the flared out portion 315. Said rib 323 not only contributes at the tightness of the assembly between the expansion tank 311 and the water box 319, but contributes also to the mechanical strength of the expansion tank under the effect of the inner pressure. The groove 324 provides a rib 320 in the expansion tank wall.

The summit wall 322 of the water box 319 engaged by its peripheral rib 323 in the groove 324 of the expansion tank 311 forms a surface bracing for said expansion tank, conferring to the latter a sufficient mechanical strength although its walls may be relatively thin and made of a cheap material. The cooperation of the rib 323 with the groove 324 provides simultaneously the anchoring of the water box and the positioning of said box.

When assembling the expansion tank 311 with the hollowed plate, the cooperation of the groove 324 with the rib 323 biases the water box 319 against the manifold.

This embodiment is particular advantageous when the water box comprises through-going passages, for instance for a thermo-contact 328 the rod 329 of which extends through the flared out portion 316 of the expansion tank as well as the wall 330 of the water box, which is formed with a depression for housing a nut 322.

Figure 28:
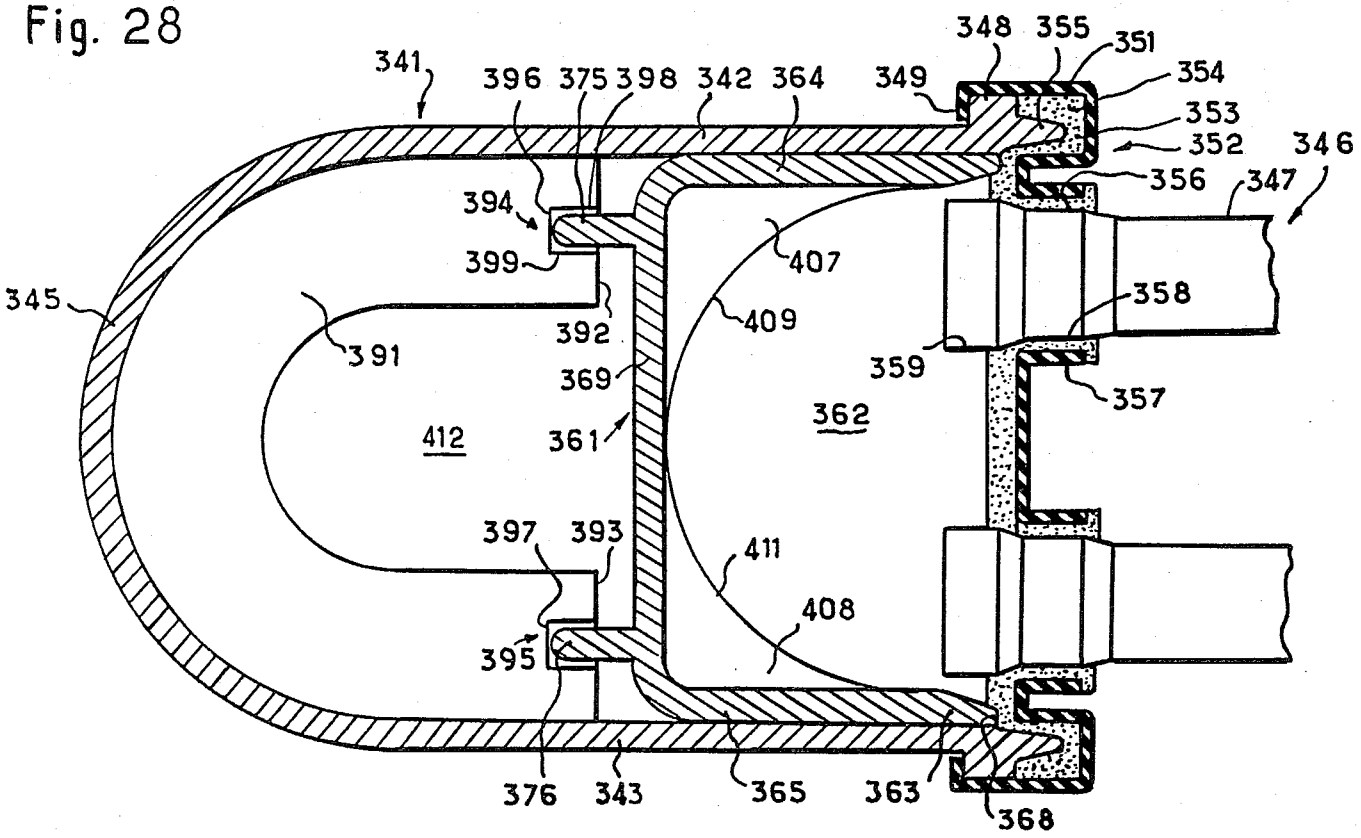
FIG. 28 is a cross-sectional view of a tank and water box device.
Figure 29:
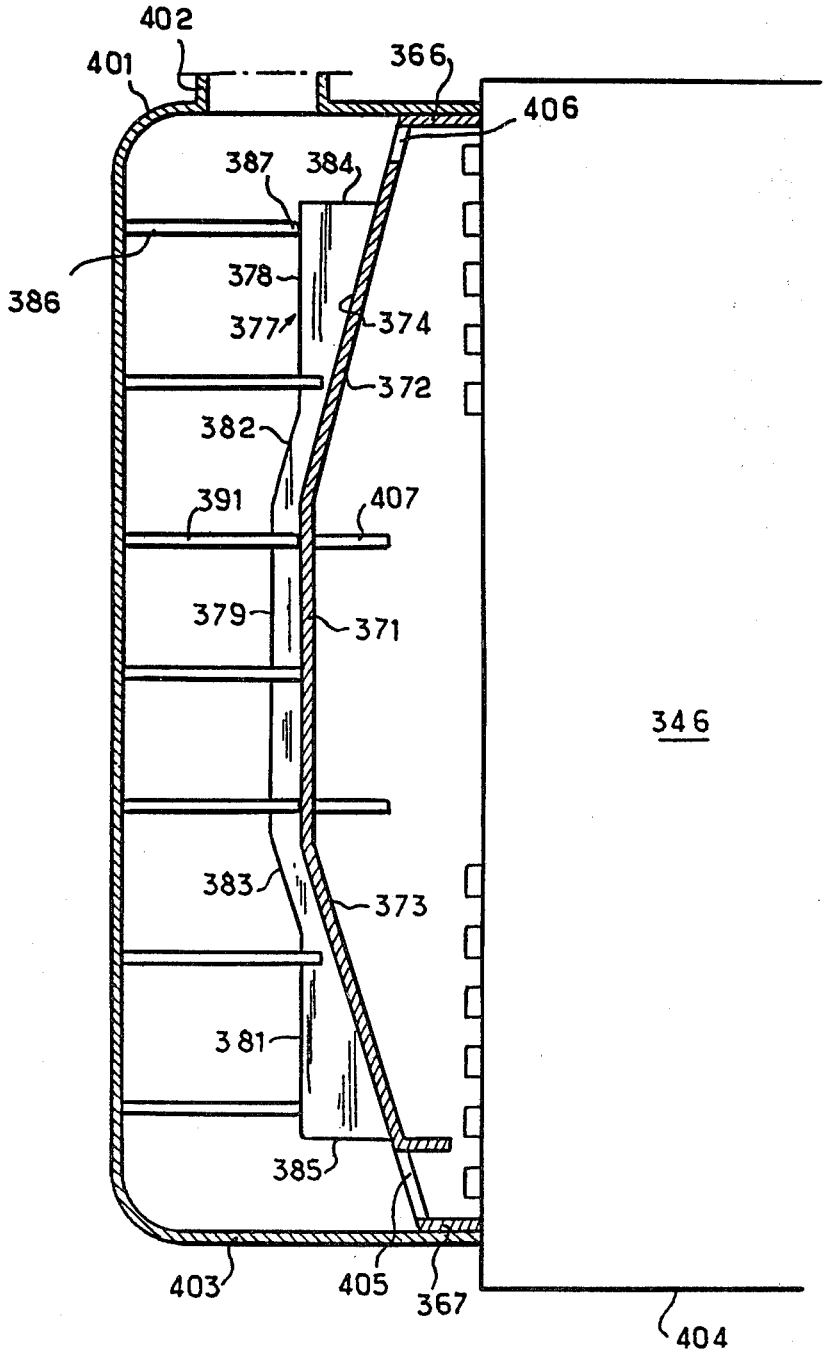
FIG. 29 is a corresponding vertical cross-sectional view, at a larger scale.

Reference is now being made to FIGS. 28 and 29. In this embodiment, the expansion tank 341, limited by two high parallel vertical walls 342 and 344 connected by a semi-cylindrical wall 345 as well as by two horizontal walls, is used for the assembly of the expansion tank and water box device with the nest 346 of tubes 347 of the exchanger through the agency of a peripheral bead 348 bordering its opening and against which bear the folded over portions 349 of the peripheral edge 351 of the manifold or hollowed plate 352, an elastomeric plate or leaf 352 contributing by its marginal beading 354 to the tightness when engaging a spout 355 of the expansion tank. The leaf 353 contributes by its sleeves 356 which are squeezed between on the one hand flanges 357 of the manifold 352 or hollowed plate turned towards the bodies of tubes 347 and on the other hand the ends of the tubes, to the tightness of the areas where the tubes extend through the hollowed plate, the tightening affecting a first portion 358 of larger diameter of the tubes, followed by a second portion 359 of a still larger diameter.

The elastomeric leaf 353 contributes also to the tight assembly of the water box 361 limiting with the manifold 352 the collecting chamber 362, the edge 363 of the water box walls 364, 365, 366 and 367, (FIG. 9), ending to this end into a thinned portion 368.

The outer wall 369 or bottom of the water box 361 comprises a central portion 371 parallel to the hollowed plate 352 and respectively two upper and lower slanted portions 372 and 373 which, from the portion 371, come closer to the manifold 352, the vertical longitudinal section of the water box being thus of trapezoidal configuration.

From the outer face 374 of the outer wall 369 of the water box 361 depend two ribs or retainers 375 and 376 the outer edge 377 of which is formed with three vertical sections 378, 379, 381 connected by oblique portions 382, 383, whereby the ribs 375 and 376 do not extend to the upper wall 366 and lower wall 367 and being limited by horizontal edges 384 and 385.

The outer edges 377 of the ribs 375 and 376 are engaged with transverse wall or rib elements 386, 391 depending from the semi-cylindrical wall 235 of the expansion tank 341 and walls 342 and 343, and are obtained when moding the tank, and are of two types: the ribs of the first type 386 simply bear via their edges 387 against the sections 378 and 381 of edge 377 of ribs 375 and 376; the ribs of the second type 391 are formed on their inner edges 392 and 393 with rectangular notches 394 and 395 the bottom 396 and 397 of which contribute, by bearing against the longitudinal ribs 375 and 376, to the application under pressure of the water box 361 against the manifold 352 through the elastomeric leaf 356 and contribute thereby to the tightness of the assembly of the water box with the manifold. The perpendicular portions 398, 399 of the notches 394 and 395 provide the tightening of the expansion tank 341 through said walls 391, providing said expansion tank with an excellent mechanical strength with regards to the efforts caused by the pressure which can prevail inside the expansion tank.

The upper wall 401 of the latter comprises the mouthpiece 402 adapted for mounting the automatically opening and closing clapper-valve and the lower wall 403 is slightly recessed relative to the lower face 404 of the nest 346 of the exchanger finned tubes.

The oblique portion 373 of the outer wall 369 of the water box 361 is formed at its lower portion with a wide communication opening 405 between the lower portion of the collecting chamber 362 and the lower portion of the compensation chamber 412. The small opening 406 at the top of the upper portion 374 of the outer wall 369 allows exchanges of fluid flowing at a reduced rate for the good operation of the expansion tank.

To the rigidity of the water box 261 contribute the wall elements 407 and 408 obtained when moding the water box and formed with circular inner edges 409 and 411.

The invention applies also to a heat exchanger in which the tubes of the nests are assembled to the manifold by a crimping operation.

It applies also to the heat exchangers comprised of a single water box providing two collecting chambers between which are interposed the tubes of the nests which are then U-shaped.

It applies also to heat exchangers with vertical tubes.

We claim:

1. In a heat exchanger for an automotive vehicle, said heat exchanger including a plurality of substantially parallel heat exchanging tubes and a collector plate having a plurality of openings, each of said openings being traversed, respectively, by an end of one of said tubes for the purpose of mounting the same, the combination of:

(a) an expansion tank;

(b) said expansion tank having a peripheral edge portion sealingly connected to said collector plate;

(c) a water box disposed inside said expansion tank, said water box comprising a partition separate from said expansion tank;

(d) said partition having a hollow cross sectional profile and two opposed longitudinal edges engaging said collector plate on each side of said tube ends, respectively, to define a collector chamber between said partition and said collector plate;

(e) said partition also forming a compensation chamber between said water box and said expansion tank;

(f) means for holding said partition in place between said expansion tank, and said collector plate when said expansion tank and collector plate are sealingly connected; and (g) said means for holding including at least one rib interposed between said expansion tank and said partition.

2. The combination of claim 1 wherein there is a plurality of longitudinally spaced apart ribs extending in a transverse direction.

3. The combination of claim 2, wherein said expansion tank has an inner wall enclosing said compensation chamber and said spaced apart ribs depend from said inner wall to brace said expansion tank against deformation generated by internally applied pressure.

4. The combination of claim 3, wherein said inner wall of the expansion tank includes a header section and opposite side walls joining said header section to said peripheral edge and each of said spaced apart ribs connect said opposite side walls across said compensation chamber and has a free transverse edge engaging a portion of said water box partition to urge the same towards said collector plate.

5. The combination of claim 4, wherein said free edge has a transverse profile matching that of said water box partition in said compensation chamber.

6. The combination of claim 5, wherein said spaced apart ribs are substantially flat wall elements transverse to the longitudinal direction of said water box partition, said flat wall elements having an hour-glass shaped contour.

7. The combination of claim 4, comprising a filling tube at one end and of said expansion tank longitudinally thereof and said header section is in alignment with a portion of the inner surface of said filling tube, and said spaced apart ribs have a free edge opposite said header section which has a curved profile in substantial alignment with that of a corresponding portion of the inner surface of said filling tube.

8. The combination of claim 2, wherein said expansion tank has an inner wall which includes a header section and opposite side walls joining said header section to said peripheral edge and each of said spaced apart ribs depends from said header section and has a free edge engaging a portion of said water box partition to urge the same against said collector plate.

9. The combination of claim 8, wherein said spaced apart ribs also depend from said opposite side walls.

10. The combination of claim 9, further including a filling tube having a substantially cylindrical inner surface at one end of said expansion tank longitudinally thereof and wherein each of said spaced apart ribs includes a flat wall element having a hole therethrough whose edge is in substantial alignment with the inner surface of said filling tube.

11. The combinaion of claim 9, wherein said free edge has a profile matching that of said water box partition thereof.

12. The combination of claim 9, wherein said spaced apart ribs comprise pairs of substantially flat coplanar wall elements protruding from said inner surface of said expansion tank in a transverse direction, the wall elements of each pair having a space therebetween sufficiently wide for allowing fluid in said compensation chamber to pass therethrough.

13. The combination of claim 9, wherein each of said spaced apart ribs comprises a wall element protruding integrally of said expansion tank in a transverse direction and having a free edge facing towards said collector plate.

14. The combination of claims 4 or 8, wherein said header portion of said expansion tank has a curved cross-section.

15. The combination of claims 4 or 8, wherein said header section of the expansion tank is substantially flat.

16. The combination of claim 2, wherein said water box partition has a longitudinal profile which is inclined with respect to the longitudinal direction of said expansion tank, so that width of said collector chamber increases with the flow of fluid discharged therein by said fluid tubes ends.

17. The combination of any of claim 2, wherein said water box partition has a longitudinal profile comprising a central portion substantially parallel to said collector plate and two end portions which are inclined towards said collector plate to narrow said collector chamber towards the longitudinal ends thereof.

18. The combination of claims 16 or 17, wherein said spaced apart ribs have a variable extent transversely of said compensation chamber to engage said inclined profile of the water box partition.

19. The combination of claim 1, wherein said collector plate includes seal means engaged by said longitudinal edges of the water box for providing fluid tightness between said collector plate and said water box along the peripheral longitudinal edges thereof.

20. The combination of claim 19, wherein said seal means is operative to resiliently urge said water box against said expansion tank.

21. In a heat exchanger for an automotive vehicle, said heat exchanger including a plurality of substantially parallel heat exchanging tubes and a collector plate having a plurality of openings, each of said openings being traversed, respectively, by an end of one of said tubes for the purpose of mounting the same, the combination of:

(a) an expansion tank;
(b) said expansion tank having a peripheral edge portion sealingly connected to said collector plate;
(c) a partition disposed within said expansion tank, said partition being separate from said expansion tank;
(d) said partition dividing the space within said expansion tank into a collector chamber and a compensation chamber;
(e) said collector chamber enclosing said tube ends adjacent to said collector plate;
(f) said compensation chamber being adjacent to said expansion tank;
(g) means for holding said partition in place between said expansion tank and said collector plate when said expansion tank is sealingly connected to said collector plate; and
(h) said means for holding including at least first and second transversely spaced apart integral ribs protruding from said partition in a direction away from said collector chamber for engaging respective portions of the expansion tank to brace said expansion tank against deformation when internal pressure is applied therein.

22. The combination of claim 21, further comprising other ribs integral with said expansion tank and extending in a transverse direction inwardly thereof, said other ribs having notches formed therein to provide said bracing portions of said expansion tank, said transversely spaced apart ribs being engaged into said notches whereby said partition is urged towards said collector plate by engagement from bottom portions of said notches, and wherein said bracing portions of said notches are engaged for bracing said tank against transverse deformation under internally applied pressure.

23. The combination of claim 22, wherein said partition further includes bracing ribs inwardly protruding into said collector chamber.

24. The combination of claim 23, wherein said bracing ribs are substantially flat wall elements and said other ribs on said expansion tank are substantially flat wall elements which are substantially coplanar with said partition bracing ribs.

25. The combination of claim 22, wherein said partition has a longitudinal profile including at least a section inclined with respect to said collector plate.

26. The combination of claim 25, wherein said other ribs on said expansion tank include ribs engaging said partition directly to urge the same towards said collector plate.

27. In a heat exchanger for an automotive vehicle, said heat exchanger including a plurality of substantialy parallel heat exchanging tubes and a collector plate having a plurality of openings, each of said openings being traversed, respectively, by an end of one of said tubes for the purpose of mounting the same, the combination of:

(a) an expansion tank;
(b) said expansion tank having a peripheral edge portion sealingly connected to said collector plate;
(c) a water box disposed inside said expansion tank, said water box comprising a partition separate from said expansion tank;
(d) said partition having a hollow cross sectional profile and two opposed longitudinal edges engaging said collector plate on each side of said tube ends, respectively, to define a collector chamber between said partition and said collector plate;
(e) said partition also forming a compensation chamber between said water box and said expansion tank;
(f) means for holding said partition in place between said expansion tank, and said collector plate when said expansion tank and collector plate are sealingly connected; and
(g) a plurality of longitudinal ribs being interposed between said expansion tank and said partition.

28. The combination of claim 27, wherein said expansion tank comprises a header portion and opposite side walls joining said header portions to said peripheral edges and each of said opposite side walls includes two sections joined by a connecting longitudinal shoulder, a first opposite portion each of said wall section adjacent to said collector plate being spaced by a greater distance than a second opposite portion of the corresponding side wall adjacent to said header portion, each said longitudinal shoulder section having longitudinal grooves formed therein wherein said plurality of longitudinal ribs are respectively engaged to brace said side walls against outer movement by engagement with a respective lateral face of each of said grooves.

29. The combination of claim 28, wherein said partition includes opposite longitudinal side walls joining said longitudinal ribs to said opposite longitudinal edges engaging said collector plate, said longitudinal side walls extending adjacent, respectively, to said first side wall portions of said expansion tank, and one of said side walls of said partition has a recess formed therein for housing a seal element, the recessed side wall and the side wall of said expansion tank opposite thereto having corresponding coaxial openings formed therein for receiving a transducer element through said coaxial openings and said seal to provide a tight passage for said transducer into said collector chamber.

30. In a heat exchanger for an automotive vehicle, said heat exchanger including a plurality of substantially parallel heat exchanging tubes and a collector plate having a plurality of openings, each of said openings being traversed, respectively, by an end of one of said tubes for the purpose of mounting the same, the combination of:

(a) an expansion tank;
(b) said expansion tank having a peripheral edge portion sealingly connected to said collector plate;
(c) a water box disposed inside said expansion tank, said water box comprising a partition separate from said expansion tank;
(d) said partition having a hollow cross sectional profile and two opposed longitudinal edges engaging said collector plate on each side of said tube ends, respectively, to define a collector chamber between said partition and said collector plate;
(e) said partition also forming a compensation chamber between said water box and said expansion tank;
(f) said expansion tank having transversely spaced longitudinal shoulders formed therein;
(g) said partition including bearing portions respectively engaging said transversely spaced longitudinal shoulders whereby said expansion tank is operative to urge said water box in the direction of said collector plate; and
(h) a plurality of ribs are interposed between said partition and said collector plate for blocking said water box between said expansion and said collector plate.

31. The combination of claim 30, wherein said expansion tank includes a header portion and opposite side walls each joining a respective end of said header portion to said peripheral edge and including a respective longitudinal shoulder, and the interposed ribs are located adjacent to said side walls in said collector chamber.

32. The combination of claim 31, wherein said interposed ribs are integrally formed with said partition and extend in said collector chamber.

33. The combination of claim 30, wherein said partition further comprises transversely spaced apart longitudinal ribs thereon protruding away from said collector chamber, and each shoulder in the respective opposite side walls of said expansion tank has a longitudinal groove formed therein for receiving, respectively, one of said longitudinal ribs, to allow each said longitudinal rib to engage a lateral wall of the corresponding groove to brace said expansion tank against transverse expansion under internally applied pressure.

34. The combination of claim 30 or 33, wherein said partition has a curved cross-sectional profile with its convexity turned towards said collector chamber.

35. The combination of claim 33, wherein said longitudinal ribs and corresponding grooves have a tapering cross-sectional profile.

36. In a heat exchanger for an automotive vehicle, said heat exchanger including a plurality of substantially parallel heat exchanging tubes and a collector plate having a plurality of openings, each of said openings being traversed, respectively, by an end of one of said tubes for the purpose of mounting the same, the combination of:

(a) an expansion tank;
(b) said expansion tank having a peripheral edge portion sealingly connected to said collector plate;
(c) a water box disposed inside said expansion tank, said water box comprising a partition separate from said expansion tank;
(d) said partition having a hollow cross sectional profile and two opposed longitudinal edges engaging said collector plate on each side of said tube ends, respectively, to define a collector chamber between said partition and said collector plate;
(e) said partition also forming a compensation chamber between said water box and said expansion tank;
(f) means for holding said partition in place between said expansion tank, and said collector plate when said expansion tank and collector plate are sealingly connected;
(g) said means for holding including at least one rib interposed between said expansion tank and said partition;
(h) said compensating chamber including an outlet for gases at one end longitudinally thereof;
(i) a wide communication passage disposed between the collector chamber and the compensation chamber in the vicinity of a distant end portion of the water box with respect to said gas outlet; and
(j) a passage of relatively reduced cross section relative to said wide communication passage between the collector chamber and the compensation in the vicinity of an end of said water box close to said gas outlet.

37. The combination of claim 36, wherein there are a plurality of ribs and one of said ribs is a transverse rib protruding from the inner wall of said expansion tank to engage said water box in the immediate vicinity of said wide communication passage.

38. The combination of claim 36, wherein said wide communication passage is provided by an indentation in said water box.

39. The combination of claim 36, wherein said water box has a longitudinal extent which is less than that of said expansion tank, and the distant end of said water box is spaced from the respective end of said expansion tank to provide said wide communication passage, by a distance sufficient for said communication passage to uncover at least one of said fluid exchanging tube ends in said collector chamber.

40. The combination of any of claims 1, 2, 4, 6, 8 or 11, wherein said ribs are molded integrally with said expansion tank.

41. The combination of any of claims 21, 27 or 30, wherein said ribs are molded of plastic material integrally with said partition.

42. In a heat exchanger including a collector plate having a plurality of openings therein and a plurality of substantially parallel heat exchanging tubes each of which has an end mounted through a respective one of said openings, the combination of an expansion tank having peripheral edge portions sealingly connected to said collector plate on either side of the ends of said tubes, a water box housed inside said expansion tank to divide the space between said expansion tank and said collector plate into a collector chamber adjacent to said collector plate and a compensation chamber adjacent to said expansion tank, further comprising means on said water box and expansion tank including a plurality of cooperating recesses and ribs engaged therein for coupling said water box and said expansion tank to brace the same against deformation under pressure applied internally thereof.

43. The combination of claim 42, wherein said ribs are also interposed between said expansion tank and said water box to block the water box in position between said expansion tank and said collector plate when said tank and collector plate are sealingly connected.

44. The combination of claim 42 or 43, wherein said recesses include a plurality of longitudinal grooves formed in said expansion tank and said ribs include longitudinal ribs on said water box, said grooves and said ribs having respective rectangular cross-sections.

45. The combination of claim 42 or 43, wherein said expansion tank has a plurality of longitudinal grooves formed therein for receiving respective ones of said longitudinal ribs, and said grooves and ribs have a tapering transverse cross-section.

* * * * *